US011633042B2

(12) United States Patent
Duggins

(10) Patent No.: US 11,633,042 B2
(45) Date of Patent: Apr. 25, 2023

(54) BRACKET FOR BALL BEARING DRAWER SLIDE

(71) Applicant: Tenn-Tex Plastics, Inc., Colfax, NC (US)

(72) Inventor: William Duggins, Kernersville, NC (US)

(73) Assignee: Tenn-Tex Plastics, Inc., Colfax, NC (US)

( * ) Notice: Subject to any disclaimer, the term of this patent is extended or adjusted under 35 U.S.C. 154(b) by 0 days.

(21) Appl. No.: 17/242,355

(22) Filed: Apr. 28, 2021

(65) Prior Publication Data

US 2021/0353060 A1 Nov. 18, 2021

Related U.S. Application Data

(60) Provisional application No. 63/023,328, filed on May 12, 2020, provisional application No. 63/205,640, filed on Mar. 19, 2021.

(51) Int. Cl.
*A47B 88/487* (2017.01)
*A47B 88/43* (2017.01)

(52) U.S. Cl.
CPC ..... *A47B 88/487* (2017.01); *A47B 88/43* (2017.01); *A47B 2210/0032* (2013.01); *A47B 2210/0054* (2013.01); *A47B 2210/09* (2013.01)

(58) Field of Classification Search
CPC ... A47B 88/487; A47B 88/407; A47B 88/423; A47B 88/43; A47B 2210/0032; A47B 2210/0054; A47B 2210/09
See application file for complete search history.

(56) References Cited

U.S. PATENT DOCUMENTS

| | | | | |
|---|---|---|---|---|
| 7,331,644 | B2 * | 2/2008 | Lowe | A47B 88/463 312/334.4 |
| 8,911,037 | B2 | 12/2014 | Hightower | |
| 10,905,238 | B1 * | 2/2021 | Shyu | A47B 88/43 |
| 2002/0074915 | A1 * | 6/2002 | Shih | A47B 88/43 312/334.5 |
| 2002/0101143 | A1 * | 8/2002 | Crooks | A47B 88/43 312/334.7 |
| 2005/0264146 | A1 * | 12/2005 | Fitz | A47B 88/43 312/334.5 |
| 2011/0234072 | A1 * | 9/2011 | Hightower | A47B 88/43 312/334.8 |
| 2016/0278521 | A1 * | 9/2016 | Chen | A47B 88/42 |
| 2017/0354055 | A1 * | 12/2017 | Hsu | A47B 88/43 |
| 2019/0063493 | A1 * | 2/2019 | Chen | H05K 7/1489 |
| 2021/0212460 | A1 * | 7/2021 | Chen | A47B 88/423 |

* cited by examiner

*Primary Examiner* — Hanh V Tran
(74) *Attorney, Agent, or Firm* — Myers Bigel, P.A.

(57) ABSTRACT

A ball bearing drawer slide bracket includes: a vertical panel with upper and lower edges; a nub extending from a first side of the vertical panel; a rear wall positioned generally parallel to and fixed relative to the vertical panel; and a generally C-shaped channel fixed to and extending forwardly from the rear wall.

4 Claims, 7 Drawing Sheets

BRACKET FOR BALL BEARING DRAWER SLIDE

RELATED APPLICATION

The present application claims priority from and the benefit of U.S. Provisional Patent Application No. 63/023,328, filed May 12, 2020 and the benefit of U.S. Provisional Patent Application No. 63/205,640, filed Mar. 19, 2021, the disclosure of which is hereby incorporated herein by reference in full.

FIELD OF THE INVENTION

The present invention is directed generally to furniture, and more particularly to cabinets with sliding drawers and trays.

BACKGROUND OF THE INVENTION

Many cabinets, particularly those found in kitchens, include drawers for storing various items. Often, drawers are mounted to the cabinet with elongate drawer slides that are fixed to the drawer. Each drawer slide has a slide member fixed to the drawer that slidably engages a stationary member that is fixed to the walls of the cabinet or face frame (often either the slide member or the stationary member includes a small wheel that facilitates sliding motion). Some of such cabinets include multiple drawers, which can be disposed in vertically stacked fashion, side-by-side fashion, or both.

Some drawers are mounted with slides that include ball bearings for smooth relative movement. The rails of ball bearing drawer slides are typically vertically oriented (i.e., they are taller than they are wide), and are mounted on the side walk of drawers. The shape of the rails can render challenging the mounting of ball bearing drawer slides. As such, it may be desirable to provide improved components that employ this mounting technique.

SUMMARY

As a first aspect, embodiments of the invention are directed to a ball bearing drawer slide bracket. The bracket comprises: a vertical panel with upper and lower edges; a nub extending from a first side of the vertical panel; a rear wall positioned generally parallel to and fixed relative to the vertical panel; and a generally C-shaped channel fixed to and extending forwardly from the rear wall.

As a second aspect, embodiments of the invention are directed to the ball bearing slide bracket as described above in combination with a mounting bracket, wherein the mounting bracket comprises: a main panel having front and rear surfaces, upper and lower edges, and opposed side edges; an L-shaped upper flange mounted to front surface of the main panel; an L-shaped lower flange mounted to the front surface of the main panel substantially parallel to the upper flange; a recess in the main panel positioned between the upper flange and the lower flange; and means for mounting the main panel to the cabinet wall so that the rear surface confronts the rear wall. The nub of the ball bearing bracket is received in the recess, the upper edge of the vertical panel engages the upper flange, and the lower edge of the vertical panel engages the lower flange.

As a third aspect, embodiments of the invention are directed to a ball bearing drawer slide bracket comprising: a vertical panel with upper and lower edges; a nub extending from a first side of the vertical panel; a web of braces extending from a second, opposite side of the vertical panel; a rear wall positioned generally parallel to and fixed relative to the vertical panel; a generally C-shaped channel fixed to and extending forwardly from the rear wall; the C-shaped channel comprising a vertical wall, a floor attached to a lower end of the vertical wall, a ceiling attached to an upper end of the vertical wall, and upper and lower lips attached to, respectively, the ceiling and the floor; and upper and lower gussets that extend between the C-shaped channel and the rear wall and a vertical rib extending between the upper and lower gussets.

DETAILED DESCRIPTION

Figure 1:
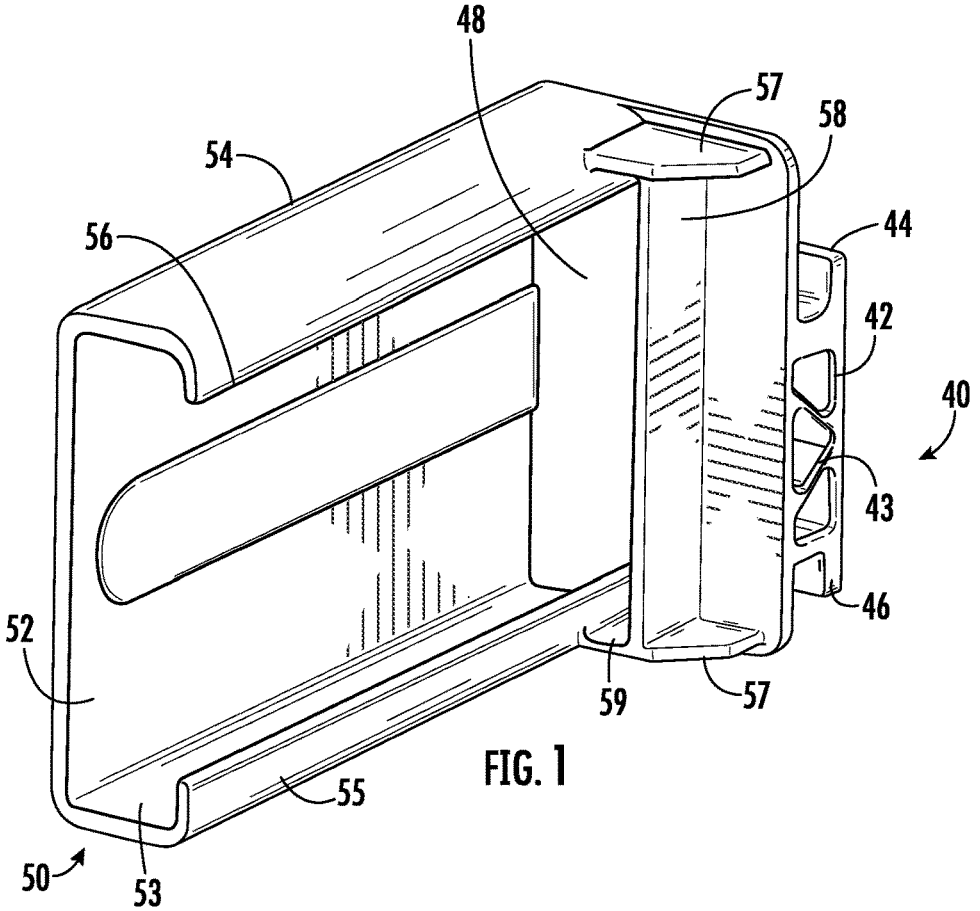
FIG. 1. is a front perspective view of a ball bearing slide bracket useful in mounting ball bearing drawer slides in cabinets according to embodiments of the invention.
Figure 2:
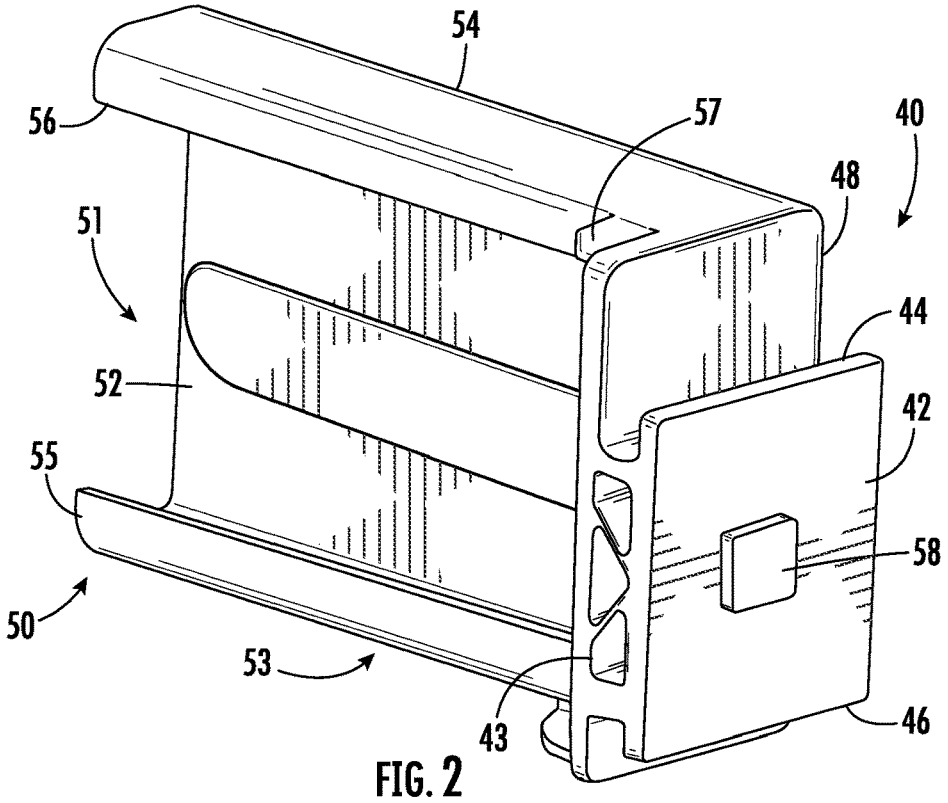
FIG. 2 is a rear perspective view of the bracket of FIG. 1.
Figure 3:
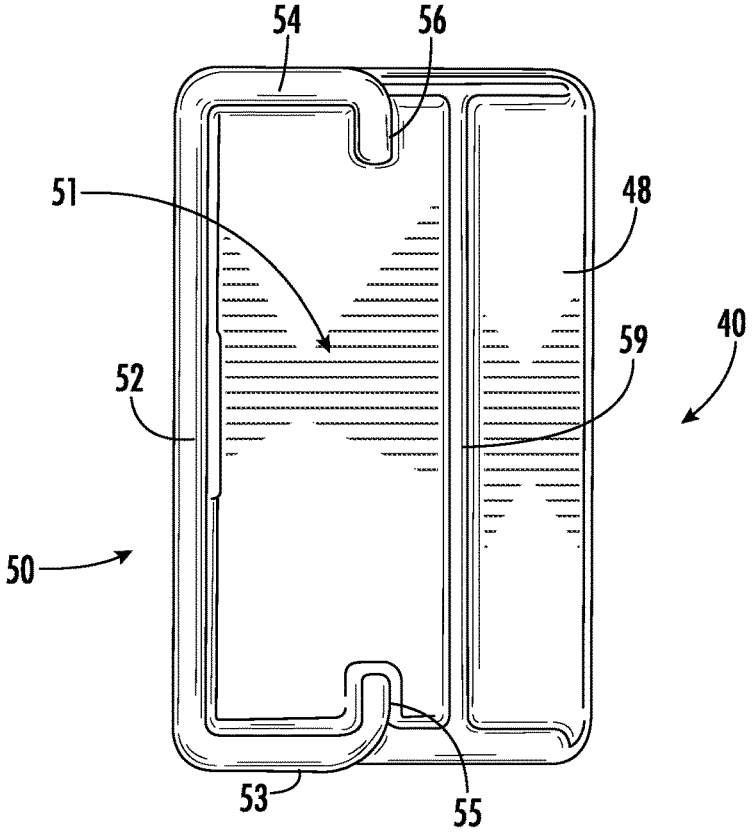
FIG. 3 is a front view of the bracket of FIG. 1.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

Referring now to the drawings, a ball bearing slide bracket, designated broadly at 40, is shown in FIGS. 1-4. The ball bearing slide bracket 40 has a vertical panel 42 that includes an upper edge 44 and a lower edge 46. A web of braces 43 connects the vertical panel 42 to a rear wall 48. A rear nub 58 extends from the rear surface of the vertical panel 42.

A C-shaped channel 50 is mounted to the rear wall 48 and extends forwardly therefrom. The channel 50 has a vertical lateral wall 52, a floor 53, a ceiling 54, and lips 55, 56 that extend toward each other from the ends of the floor 53 and ceiling 54 and defined a cavity 51. Gussets 57 extend horizontally away from the lips 55, 56. A rib 59 spans the gussets 57.

The bracket 40 is typically formed of a thermoplastic polymeric material, and is typically injection-molded. Any suitable polymeric material may be used, such as ABS, PPE, PPO, acetal, polycarbonate, polyester, nylon, polyethylene, polypropylene, PVC, or the like, which may be filled (e.g., with fiber, glass, talc, or other known fillers) or unfilled.

Figure 4:
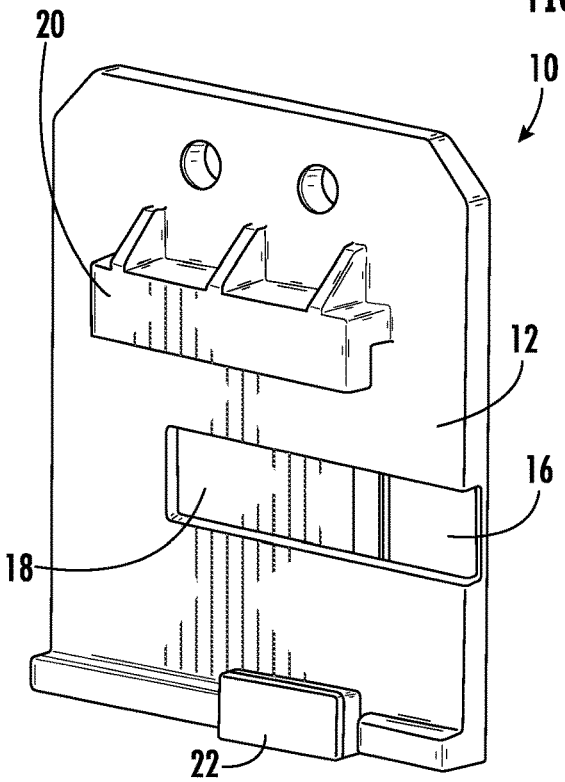
FIG. 4 is a front perspective view of a mounting bracket that can be used with the ball bearing drawer slide bracket of FIG. 1.
Figure 5:
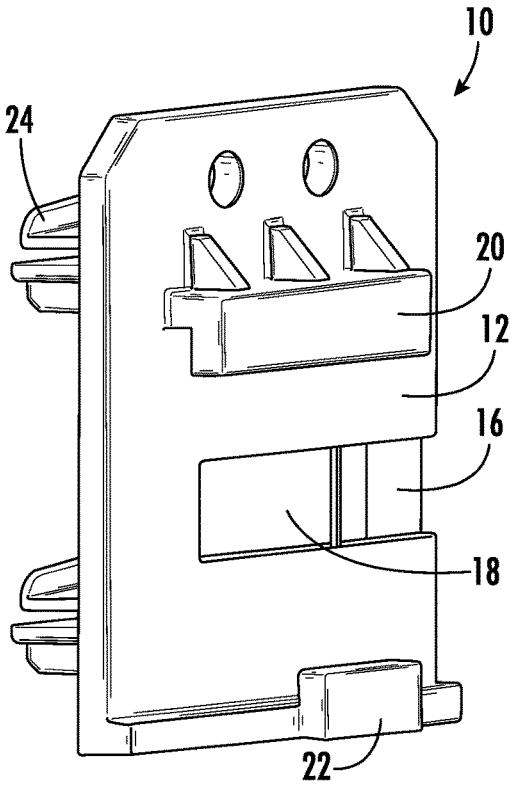
FIG. 5 is an opposite front perspective view of the mounting bracket of FIG. 4.
Figure 6:
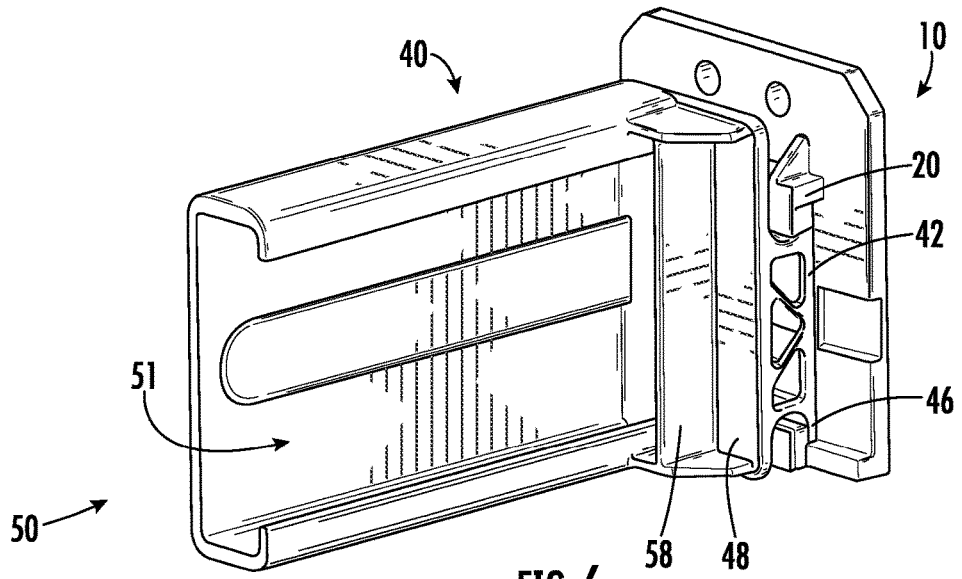
FIG. 6 is a front perspective view of the ball bearing slide bracket of FIG. 1 mounted on the mounting bracket of FIG. 4.

The use of the ball bearing slide bracket 40 can be understood by reference to FIGS. 4-6. As described in detail in U.S. Pat. No. 8,911,037, supra, a mounting bracket 10 (shown in FIGS. 4 and 5) includes a main panel 12. An L-shaped upper flange 20 projects from the front side of the main panel 12 and extends downwardly, and another L-shaped lower flange 22 projects from the front side of the main panel and extends upwardly. An access ramp 16 leads from one edge of the main panel 12 toward the center thereof. The access ramp 16 leads to a rectangular recess 18 that extends horizontally between the upper and lower flanges 20, 22. The inwardmost portion of the access ramp 16 juts forwardly (i.e., toward the front surface of the main panel 12), with the result that the recess is bounded on all sides: on three sides by the main panel 12, and on the fourth side by the inwardmost portion of the access ramp 16.

The back side of the main panel 12 may include features, such as split dowels 24, that enable the bracket 10 to be mounted to a rear cabinet wall. In other embodiments, holes in the main panel 12 may receive screws for mounting the bracket 10 to the wall.

The mounting bracket 10 is typically of unitary construction, but may be formed of multiple components if desired. The mounting bracket 10 may be formed of any material suitable for the mounting of drawer slides; a polymeric material, such as those described above, is typically employed.

As can be seen in FIG. 6, interconnection of the mounting bracket 10 and the ball bearing slide bracket 40 is accomplished by sliding the upper edge 44 of the vertical panel 42 into the pocket created by the upper flange 20, and by sliding the lower edge 46 of the vertical panel 42 into the pocket created by the lower flange 22 (FIG. 6). When so positioned, the rear nub 58 is received in the access ramp 16 in the main panel 12. The ball bearing slide bracket 40 is then slid toward the center of the mounting bracket 10 until the rear nub 58 is received in and captured by the rectangular recess 18. Once the nub 58 is positioned within the recess 18, the ball bearing slide bracket 40 is free to slide horizontally relative to the main panel 12 until the nub 58 strikes either of the side edges of the recess 18. Thus, the position of the ball bearing slide bracket 40 relative to the mounting bracket 10 can be adjusted.

Figure 7:
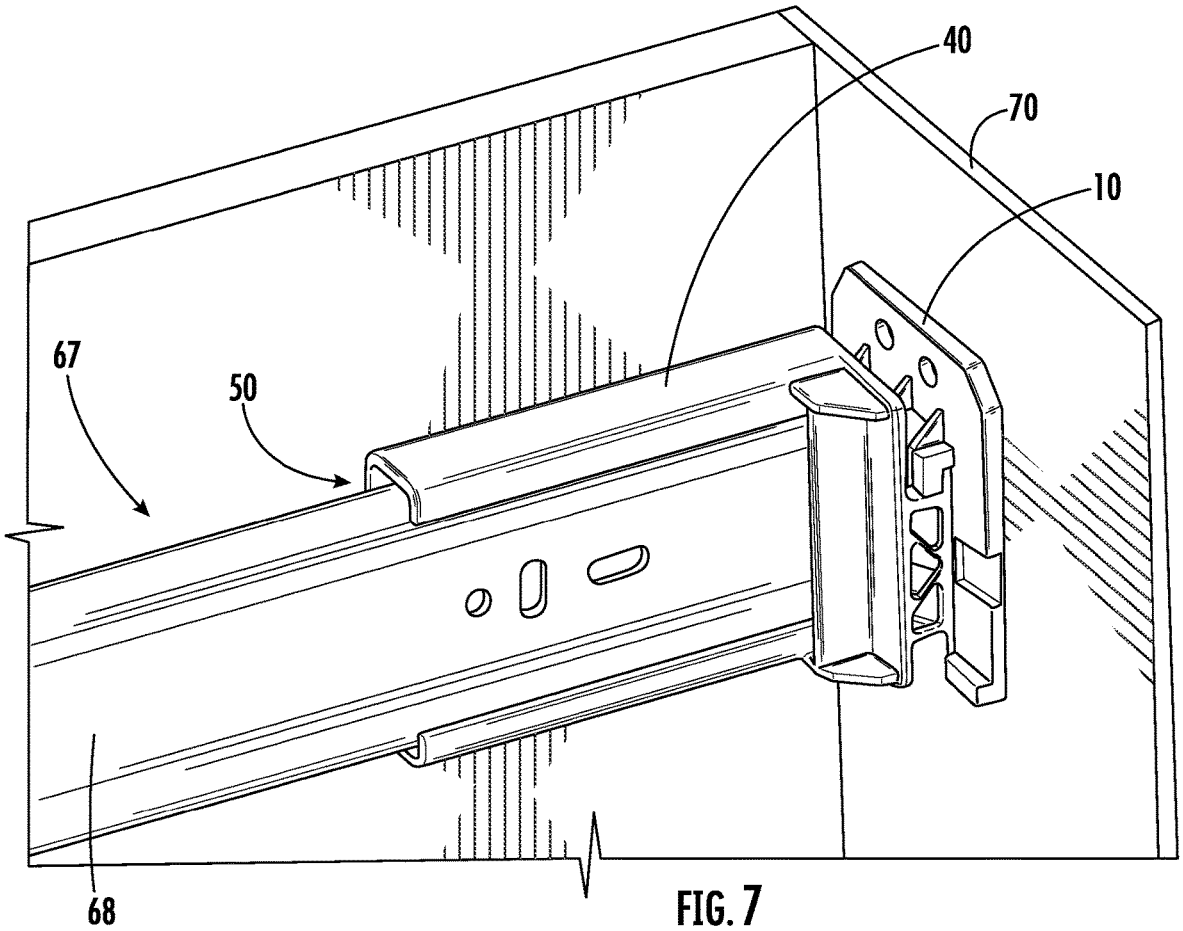
FIG. 7 is a front perspective view of the ball bearing slide bracket of FIG. 1 mounted on a bracket of FIG. 5, which is in turn mounted to the rear wall of a cabinet, wherein a drawer slide is being inserted into the channel of the ball bearing slide bracket.

Referring now to FIG. 7, once the mounting bracket 10 and ball bearing slide bracket 40 have been mounted to the cabinet wall or face frame 70 (typically by the manufacturer), a ball bearing drawer slide 67 can be mounted to the ball bearing slide bracket 40. Typically, the drawer slide 67 will not already be attached to the side or underside of a drawer, although this need not be the case. Mounting is achieved by sliding an elongate member 68 of the drawer slide 67 into the channel 50 of the ball bearing slide bracket 40. The channel 50 is typically sized so that the member 68 of the drawer slide 67 fits therewithin via an interference fit. Typically dimensions of the cavity within the channel 50 are 1 to 3.125 inches in height by 0.25 to 0.75 inches in width. In some embodiments, the height may be about 1.8 to 1.85 inches and the width may be about 0.42 to 0.45 inches. This range may be particularly useful in enabling the ball bearing slide bracket 40 to receive and mount a number of different ball bearing drawer slides made by different manufacturers.

Notably, because the ball bearing slide bracket 40 is free to slide horizontally relative to the mounting bracket 10, the horizontal position of the ball bearing slide bracket 40 can be adjusted so that the drawer slide 67 can be received more readily and easily even if the drawer slide 67 is already mounted to the drawer.

The ball bearing slide bracket 40 can facilitate the installation of ball bearing drawer slides as compared to prior installation components. Past systems have include a mounting bracket similar to the mounting bracket 10, a complimentary bracket with a vertical panel and a nub that fits within the recess 16 of the mounting bracket 10, and a steel L-shaped bracket that is screwed onto the side of the complimentary bracket opposite the nub. The ball bearing drawer slide then attaches to the L-shaped bracket. Use of the ball bearing slide bracket 40 can simplify the mounting process greatly, as there is no separate L-shaped bracket that must somehow be secured to the complimentary bracket. Instead, the ball bearing slide bracket 40 is simply slid into place on the mounting bracket 10, and the ball bearing drawer slide is slid into the channel 50. Thus, the system saves on the number of parts and labor steps.

It should also be noted that the dimensions of the upper and lower edges 44, 46 of the ball bearing slide bracket 40, the upper and lower flanges 20, 22, and/or the nub 58 may be selected so that there is some frictional resistance to horizontal movement of the nub 58 within the recess 18. Such frictional resistance can limit unwanted horizontal movement, such that once the position of the ball bearing slide bracket 40 has been adjusted, the ball bearing slide bracket 40 remains in place and provides stable mounting to the drawer slide 67.

It should be noted that the bracket 10 may take a large variety of different configurations, particularly on the rear side of the main panel 12, that enable the bracket 10 of choice to be used with a particular cabinet wall 70. Generally speaking, manufacturers of cabinets often employ several different hole patterns for mounting of the bracket 10. Virtually any of the brackets 10 that may be employed with such a cabinet may be used with the ball bearing slide brackets 40 described herein. As a result, "mixing and matching" of the combination of the brackets 10, the ball bearing slide bracket 40, and the drawer slides 67 is facilitated by the versatility of the ball bearing slide bracket 40.

Those skilled in this art will appreciate that the ball bearing slide bracket 40 may take different configurations. For example, it may have more or fewer gussets 57. The rib 59 may be omitted, or may be accompanied by another rib. The braces 43 may be omitted or may take a different configuration. The nub 58 may be sized differently, or located in a different position (e.g., centered vs. off-centered) on the panel 42. Other configurations may also be suitable.

Another embodiment of a ball bearing slide bracket, designated broadly at 140, is shown in FIGS. 8-11. The ball bearing slide bracket 140 is similar in many respects to the ball bearing slide bracket 40 discussed above, but has features that may improve performance and/or manufacturability. These differences are note below.

The ball bearing slide bracket 140 has a vertical panel 142 that includes an upper edge 144 and a lower edge 146. A web of braces 143 connects the vertical panel 142 to a rear wall 148. Two gussets 157 with a gap 157*a* therebetween extend forwardly from both the upper and lower portions of the rear wall 148. A rear nub 158 extends from the rear surface of the vertical panel 142 (see FIG. 9).

Figure 8:
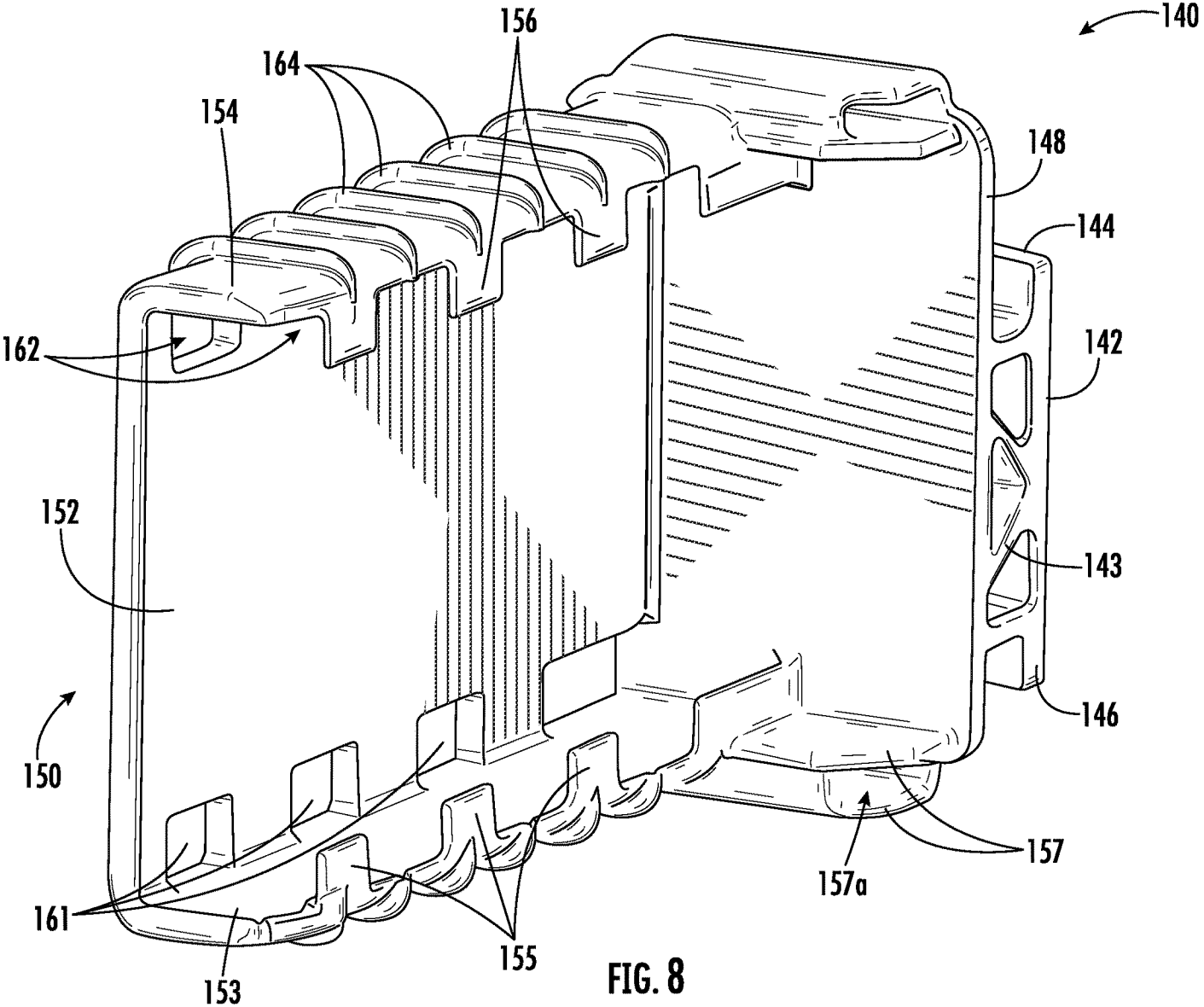
FIG. 8 is a perspective view of a ball bearing slide bracket according to additional embodiments of the invention.
Figure 9:
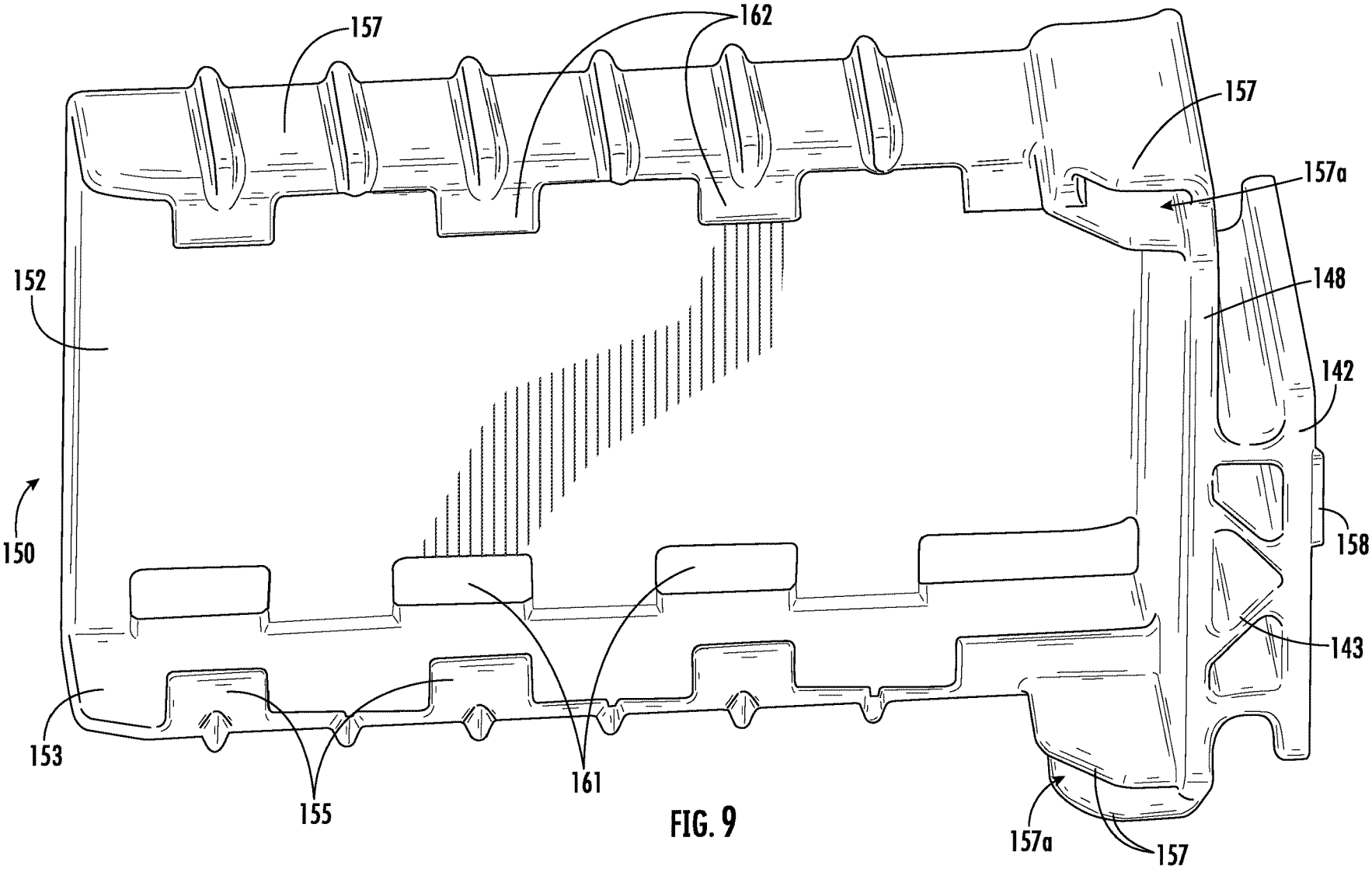
FIG. 9 is a top, side perspective view of the ball bearing slide bracket of FIG. 8.

A C-shaped channel 150 is mounted to the rear wall 148 and extends forwardly therefrom. The channel 150 has a vertical lateral wall 152, a floor 153, and a ceiling 154. However, instead of having continuous lips extending from the edges of the ceiling 154 and the floor 153, the ball bearing slide bracket 140 has a series of teeth 155 that extend upwardly from the floor 153 and a series of teeth 156 that extend downwardly from the ceiling 154. FIGS. 8 and 9 also illustrate a series of slots 161, 162 in the lateral wall 152 that are substantially aligned with the teeth 155, 156.

The teeth 155, 156 serve a similar function to the lips 55, 56 of the ball bearing slide bracket 40; i.e., they capture and secure the slide member 168 of the drawer slide 167. However, the presence of the slots 161, 162 can enable the ball bearing slide bracket 140 to be injection-molded more easily than the ball bearing slide bracket 40. More specifically, the presence of the teeth 155, 156 and the slots 161, 162 permit the use of a mold that reciprocates along only one axis (i.e., there are no "side action" mechanisms required in the mold) to form the entire ball bearing slide bracket 140. Instead, the mold halves can meet and separate along an axis normal to the lateral wall 152, with the teeth 155, 156 being formed by projections in one of the mold halves that can extend through the slots 161, 162. The absence of side action mechanisms in the mold simplifier both mold construction and mold operation considerably.

Figure 10:
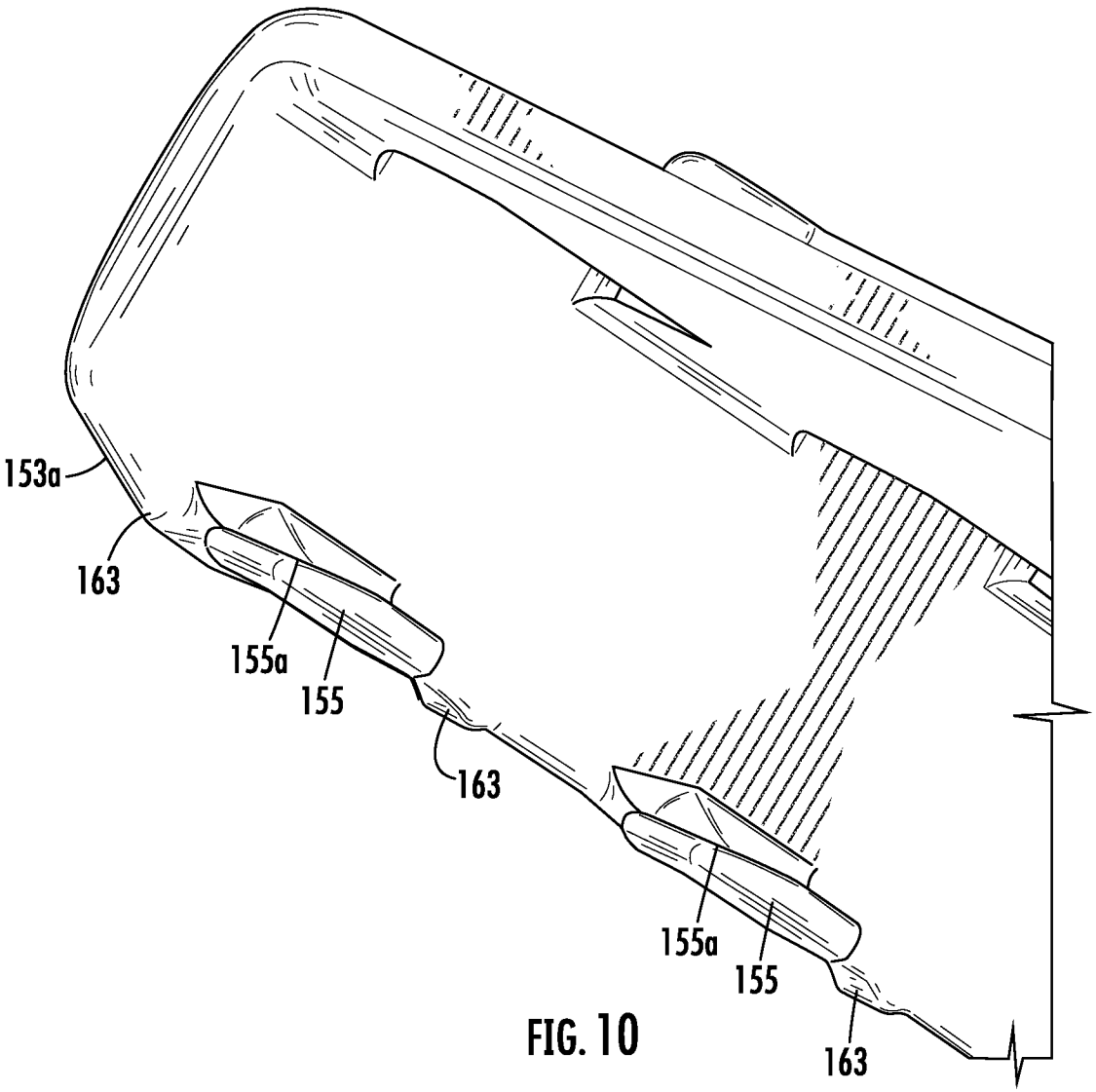
FIG. 10 is a greatly enlarged partial top perspective view f the teeth of the ball bearing slide bracket of FIG. 8.

Referring now to FIG. 10, the additional aspects of the ball bearing slide bracket 140 are shown therein. First, it can be seen that each of the teeth 155 has a slightly canted surface 155*a* extending from its "leading" edge. The presence of the canted surface 155*a* can facilitate the installation of the slide member 168 of a drawer slide 167 onto the bracket by prevent the leading of the slide member 168 from "catching" or "hanging up" on a tooth 155 as the slide member 168 is slid into place. The teeth 156 have similar canted surfaces on their leading edges.

Second, it can be seen that the floor 153 has a chamfered inner front edge 153*a*. In addition, small nubs 163 extend from the edge of the floor 153. The chamfered nature of the inner front edge 153*a* of the floor 153 can assist in preventing a drawer 171 attached to the slide member 168 from "catching" or "hanging up" on the frontmost tooth 155 as the drawer 171 slides past the ball bearing slide bracket 140 during closing of the drawer; the innermost portion of the inner front edge 153*a* extends inwardly sufficiently to force the drawer 171 away from the front tooth 155. In addition, the nubs 163 are of a sufficient size that they may also assist in guiding the drawer 171 away from the more rearward teeth 155.

A similar inner front edge 154*a* is present on the ceiling 154, similar canted surfaces are present on the teeth 156, and similar nubs are present extending from the ceiling 154, in order to perform the same functions in preventing catching during installation and drawer operation.

Figure 11:
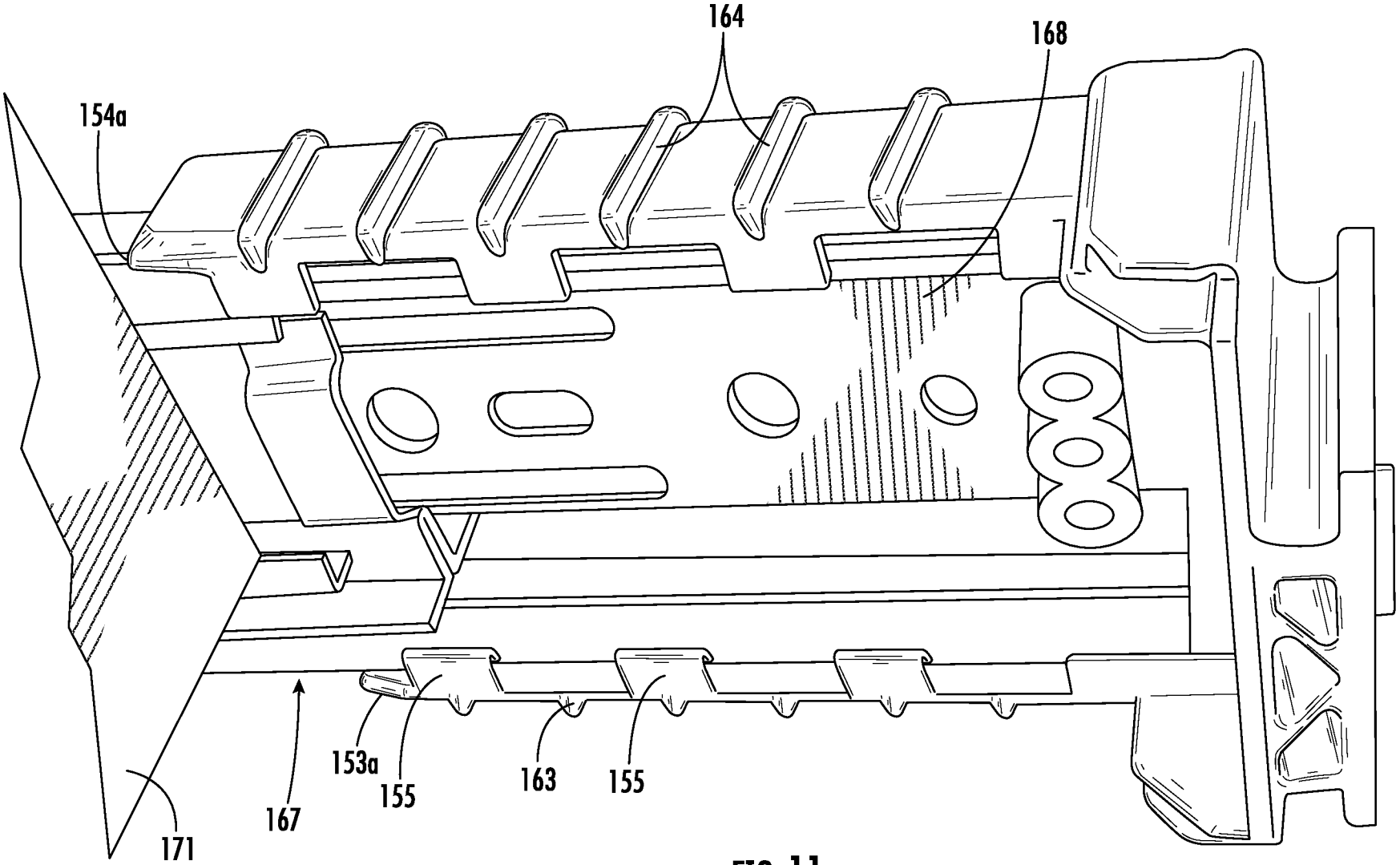
FIG. 11 is a side perspective view of the ball bearing side bracket of FIG. 8 mounted on a ball bearing drawer slide.

FIG. 11 illustrates a ball bearing drawer slide 167 with a slide member 168 attached to a drawer 171. The ball bearing slide bracket 140 would be attached to a mounting bracket (such as the mounting bracket 10 above), and in turn mounted to the rear wall of a cabinet.

Those of skill in this art will appreciate that the ball bearing slide bracket 140 can take different forms. For example, more or fewer teeth 155, 156 may be employed (as one example, there may be only on tooth 155 or 156, with a lengthy slot 161, 162 to enable the formation of a single long tooth). Ribs such as those shown at 164 may be included, omitted or modified. Either or both of the nubs 163 and the canted surfaces 155*a* may be omitted. Other variations may also be suitable.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A ball bearing drawer slide bracket formed of a polymeric material, the bracket comprising: a vertical panel with upper and lower edges; a nub extending from a first side of the vertical panel; a rear wall positioned generally parallel to, spaced from, and fixed relative to the vertical panel; a generally C-shaped channel fixed to and extending forwardly from the rear wall; the C-shaped channel comprising a vertical wall, a floor attached to a lower end of the vertical wall, a ceiling attached to an upper end of the vertical wall, and upper and lower teeth attached to, respectively, the ceiling and the floor, the C-shaped channel having a longitudinal axis that is generally perpendicular to the rear wall and further comprising a plurality of upper slots and a plurality of lower slots in the vertical wall of the C-shaped channel, wherein the upper and lower slots in the vertical wall are generally aligned with the upper and lower teeth.

2. The ball bearing bracket defined in claim 1, wherein at least one of the teeth includes a canted surface on a leading edge thereof.

3. The ball bearing bracket defined in claim 1, further comprising a chamfered inner front edge on the floor.

4. The ball bearing bracket defined in claim 1, wherein the vertical panel is attached to the rear wall via a web of braces.

* * * * *